US005385163A

United States Patent [19]

Fairchild

[11] Patent Number: 5,385,163

[45] Date of Patent: Jan. 31, 1995

[54] STEP CANES

[76] Inventor: Barbara S. Fairchild, R.D. #1, Box 284, Brockport, Pa. 15823

[21] Appl. No.: 170,758

[22] Filed: Dec. 21, 1993

[51] Int. Cl.[6] ..... A45B 1/00

[52] U.S. Cl. ..... 135/65; 135/70; 135/74

[58] Field of Search ..... 135/66, 65, 70, 77, 135/78, 81, 84, 910, 911

[56] References Cited

U.S. PATENT DOCUMENTS

| | | | |
|---|---|---|---|
| D. 324,944 | 3/1992 | Stupak . | |
| 2,642,074 | 6/1953 | Pedley et al. | 135/65 |
| 4,044,784 | 8/1977 | Smith . | |
| 4,062,371 | 12/1977 | Bolen . | |
| 4,091,828 | 5/1978 | Jorgensen | 135/66 |
| 4,258,735 | 3/1981 | Meade | 135/65 |
| 4,274,430 | 6/1981 | Schaaf et al. | 135/65 |
| 4,884,587 | 12/1989 | Mungons | 135/66 X |
| 4,977,914 | 12/1990 | Smerker | 135/81 |
| 5,056,545 | 10/1991 | Spaeth . | |

FOREIGN PATENT DOCUMENTS

| | | | |
|---|---|---|---|
| 808608 | 7/1951 | Germany | 135/81 |

*Primary Examiner*—Lanna Mai

[57] ABSTRACT

Step canes for assisting a person in walking up and down stairs comprising an elongated and rigid cane for supporting the attitude of a user, the cane having a tip end adapted to contact a walking surface, a handle end adapted to provide a user a firm grip, and a downwardly extending intermediate portion therebetween; a platform rotatably coupled to the intermediate portion of the cane, the platform operable in an extended position to allow a user to walk up and down stairs and in a retracted position to allow a user to walk on a generally level surface; and a controller mechanism coupled between the cane and platform to place the platform in either the extended or retracted position.

4 Claims, 4 Drawing Sheets

10

12
5
20
16
50
5
60
18

6
6
3
46
26
48
34
36
3
30
32
14

FIG 3
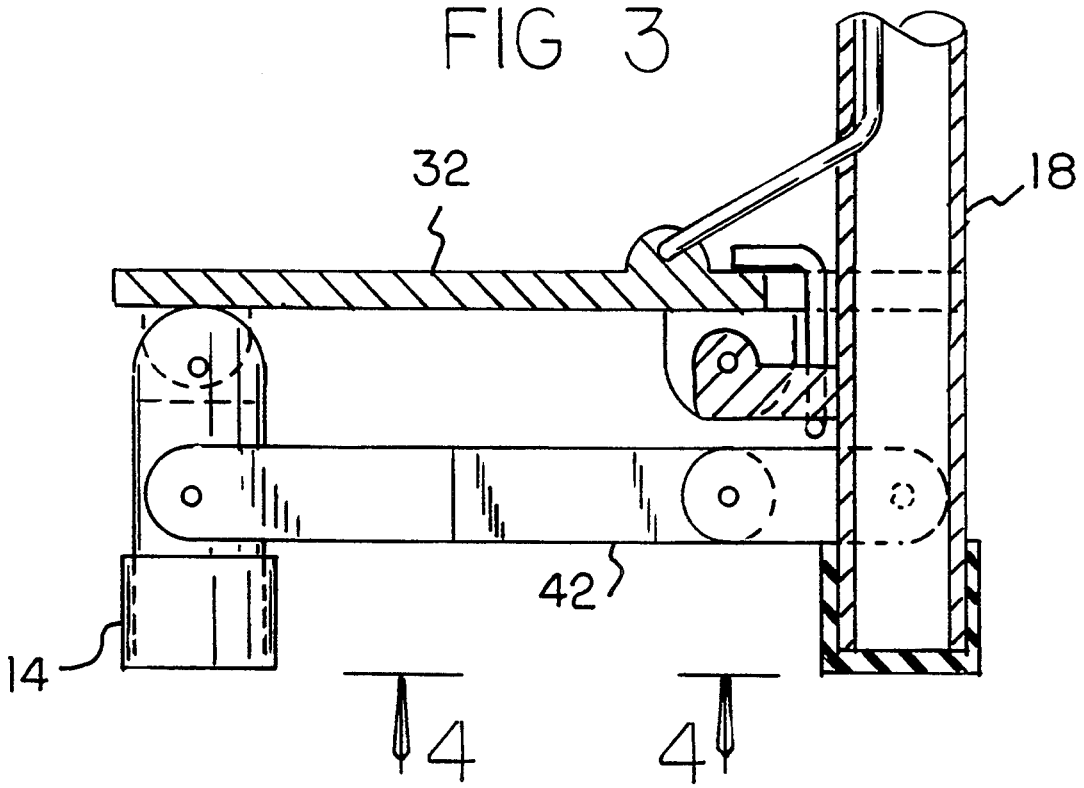
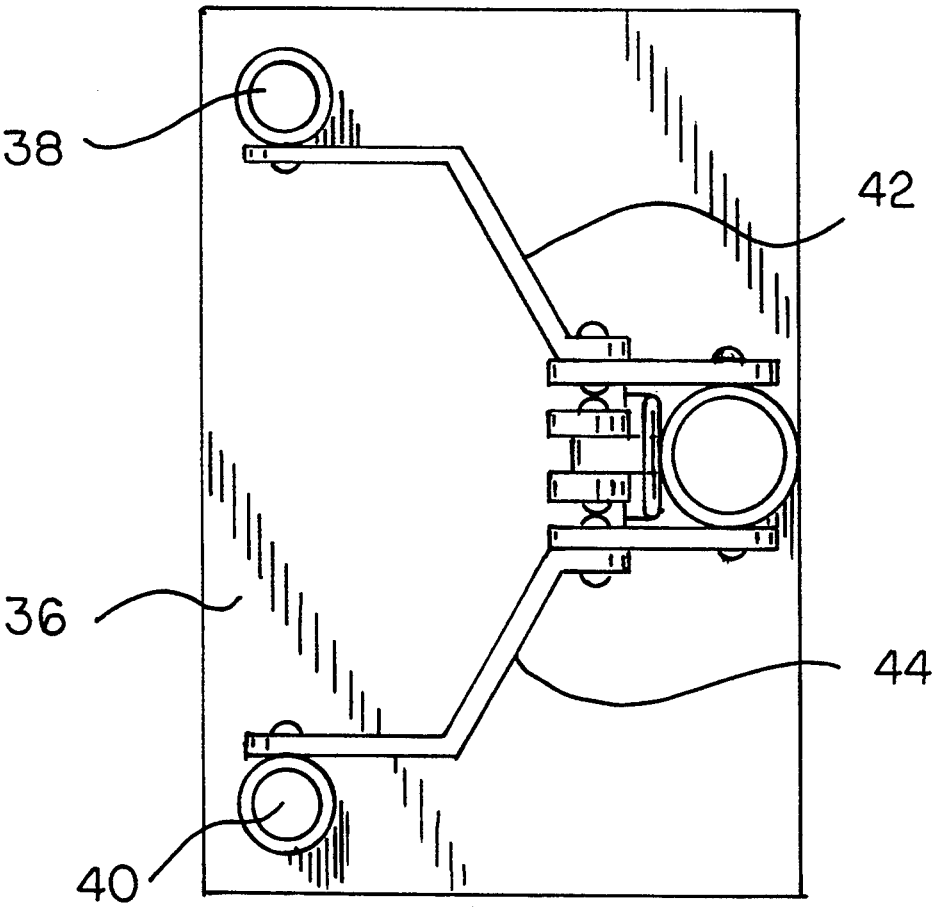
FIG 4

STEP CANES

BACKGROUND OF THE INVENTION

1. Field of the Invention

The present invention relates to a step cane and more particularly pertains to a step cane for assisting a person in walking up and down stairs.

2.Description of the Prior Art

The use of canes is known in the prior art. More specifically, canes heretofore devised and utilized for the purpose of assisting a person in walking up and down stairs are known to consist basically of familiar, expected and obvious structural configurations, notwithstanding the myriad of designs encompassed by the crowded prior art which have been developed for the fulfillment of countless objectives and requirements.

By way of example, the prior art discloses in U.S. Pat. No. 4,274,430 to Schaaf canes having the capability of assisting a person in walking on stairs.

Other patents that illustrate components generally related to the invention are U.S. Pat. Nos. 4,044,784 to Smith; 4,062,371 to Bolen; and 5,056,545 to Spaeth.

Another patent that illustrates components generally related to the present invention is U.S. Pat. No. Des. 324,944 to Stupak.

While these devices fulfill their respective, particular objective and requirements, the aforementioned patents do not describe a step cane that extends a platform when a lever thereon is placed in one position, whereby allowing a user to easily walk up and down steps, and retracts the platform when the lever is placed in another position, whereby allowing a user to walk on a generally level surface.

In this respect, the step cane according to the present invention substantially departs from the conventional concepts and designs of the prior art, and in doing so provides an apparatus primarily developed for the purpose of assisting a person in walking up and down stairs.

Therefore, it can be appreciated that there exists a continuing need for new and improved step cane which can be used for assisting a person in walking up and down stairs. In this regard, the present invention substantially fulfills this need.

SUMMARY OF THE INVENTION

In the view of the foregoing disadvantages inherent in the known types of canes now present in the prior art, the present invention provides an improved step cane. As such, the general purpose of the present invention, which will be described subsequently in greater detail, is to provide a new and improved step cane and method which has all the advantages of the prior art and none of the disadvantages.

To attain this, the present invention essentially comprises a rigid and hollow cane for supporting the attitude of a user, the cane having a tip end, and handle end, and an downwardly extending intermediate portion therebetween, the tip end adapted to contact a walking surface, the handle end adapted to provide a user a firm grip, and the intermediate portion having a releasing aperture, a lifting aperture, a coupling aperture, and an extending aperture disposed thereon, the releasing aperture disposed near the handle end, the lifting aperture disposed below the releasing aperture, the coupling aperture disposed below the lifting aperture and further including a clip spring coupled thereto, and the extending aperture disposed below the coupling aperture. Also included is a platform rotatably coupled to the cane between the tip end and the extending aperture, the platform operable in an extended position to allow a user to walk up and down stairs and in a retracted position to allow a user to walk on a generally level surface. The platform further comprises a rigid and essentially rectangular plate having an upper surface and a lower surface, the plate oriented horizontally when in the extended position and oriented vertically when in the retracted position; a first support leg and a second support leg attached to the lower surface of the plate and extending downward to contact the walking surface when the plate is in the extended position, with the tip end of the cane and the two support legs defining a tripod for supporting the plate; a first hinge and a second hinge, the first hinge connected between the first support leg and tip end of the cane, the second hinge connected between the second support leg and tip end of the cane, the hinges operable in unison to position the plate in either the extended or retracted position; and a mounting bracket coupled to the plate, the bracket having a hole disposed thereon adapted to receive a cable. A control mechanism is coupled between the cane and platform to place the platform in either the extended or retracted position, the control mechanism further comprising an elongated lift lever having a first end, second end, and intermediate portion therebetween, the first end rotatably coupled to the cane above the lifting aperture, the second end having a handle formed thereon, and the intermediate portion having a hole disposed thereon adapted to receive a cable; a lifting cable placed within the intermediate portion of the cane and having one end disposed through the extending aperture and coupled to the hole of the mounting bracket and the other end disposed through the lifting aperture and coupled to the hole of the lift lever, whereby rotating the handle of the lift lever upwards moves the platform to the retracted position and rotating the handle downwards moves the platform to the extended position; an elongated release lever having a first end, a second end, and intermediate portion therebetween, the first end having a hole formed thereon and disposed within the cane, the intermediate portion extending from the first end through the releasing aperture to the second end, the second end having a handle formed thereon; a release detent having a first end, a second end, and an intermediate portion therebetween, the first end having a hole formed thereon and disposed within the cane, the intermediate portion coupled to the lifting cable and extending from the first end through the coupling aperture to the second end, the second end having a hook formed thereon; and a releasing cable placed within the intermediate portion of the cane and having one end coupled to the hole of the release detent and the other end coupled to the hole of the release lever, whereby when the platform is in the extended position, rotating the handle of the release lever downward engages the hook with the clip spring to lock platform in place, and rotating the handle downwards disengages the hook with the clip spring to unlock the platform, thus enabling the platform to be placed in the retracted position with the lift lever.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved step cane which has all the advantages of the prior art canes and none of the disadvantages.

It is another object of the present invention to provide a new and improved step cane which may be easily and efficiently manufactured and marketed.

It is a further object of the present invention to provide a new and improved step cane which is of durable and reliable construction.

An even further object of the present invention is to provide a new and improved step cane which is susceptible of a low cost of manufacture with regard to both materials and labor, and which accordingly is then susceptible of low prices of sale to the consuming public, thereby making such a step cane economically available to the buying public.

Still yet another object of the present invention is to provide a new and improved step cane which provides in the apparatuses and methods of the prior art some of the advantages thereof, while simultaneously overcoming some of the disadvantages normally associated therewith.

Even still another object of the present invention is to provide a new and improved step cane for assisting a person in walking up and down stairs, especially a person who is temporarily or permanently incapacitated to some degree in the lower limbs.

Even still another object of the present invention is to provide a new and improved step cane that is specifically directed at helping those who are having difficulty raising a leg high enough to reach a conventional stair.

Even still another object of the present invention is to provide a new and improved step cane that allows users to negotiate obstacles such as stairs without assistance from anyone, and by doing so, permits them to remain self-sufficient.

Even still another object of the present invention is to provide a new and improved step cane that has an illumination source coupled thereto for illuminating stairs to be climbed.

Even still another object of the present invention is to provide a new and improved step cane including a retractable spike coupled to the tip of the cane and operated by the controller mechanism to pierce a walking surface when placed in an extended position, whereby allowing the step cane to be used on surfaces covered with snow and ice.

Lastly, it is an object of the present invention to provide a new improved step cane for assisting a person in walking up and down stairs comprising an elongated and rigid cane for supporting the attitude of a user, the cane having a tip end adapted to contact a walking surface, a handle end adapted to provide a user a firm grip, and a downwardly extending intermediate portion therebetween; a platform rotatably coupled to the intermediate portion of the cane, the platform operable in an extended position to allow a user to walk up and down stairs and in a retracted position to allow a user to walk on a generally level surface; and a controller means coupled between the cane and platform to place the platform in either the extended or retracted position.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a side schematic view of the platform taken along the line 3—3 of FIG. 2.

FIG. 4 is a plan view of the bottom of the platform taken along the line 4—4 of FIG. 3.

The same reference numerals refer to the same parts through the various Figures.

DESCRIPTION OF THE PREFERRED EMBODIMENT

Figures 1, 2:
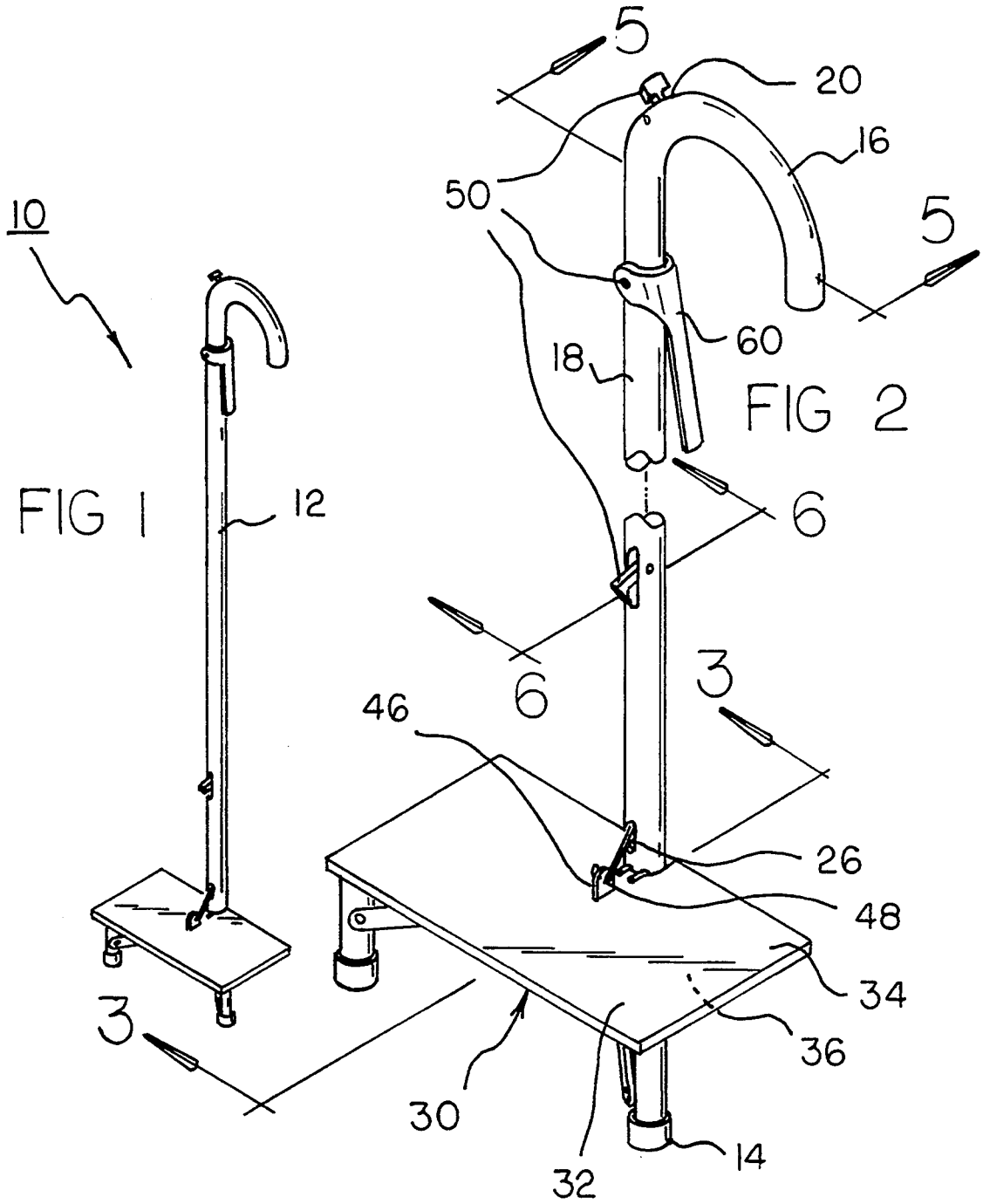
FIG. 1 is a perspective view of the preferred embodiment of the step cane constructed in accordance with the principles of the present invention.
FIG. 2 is an enlarged perspective view of the step cane of FIG. 1.
Figure 5:
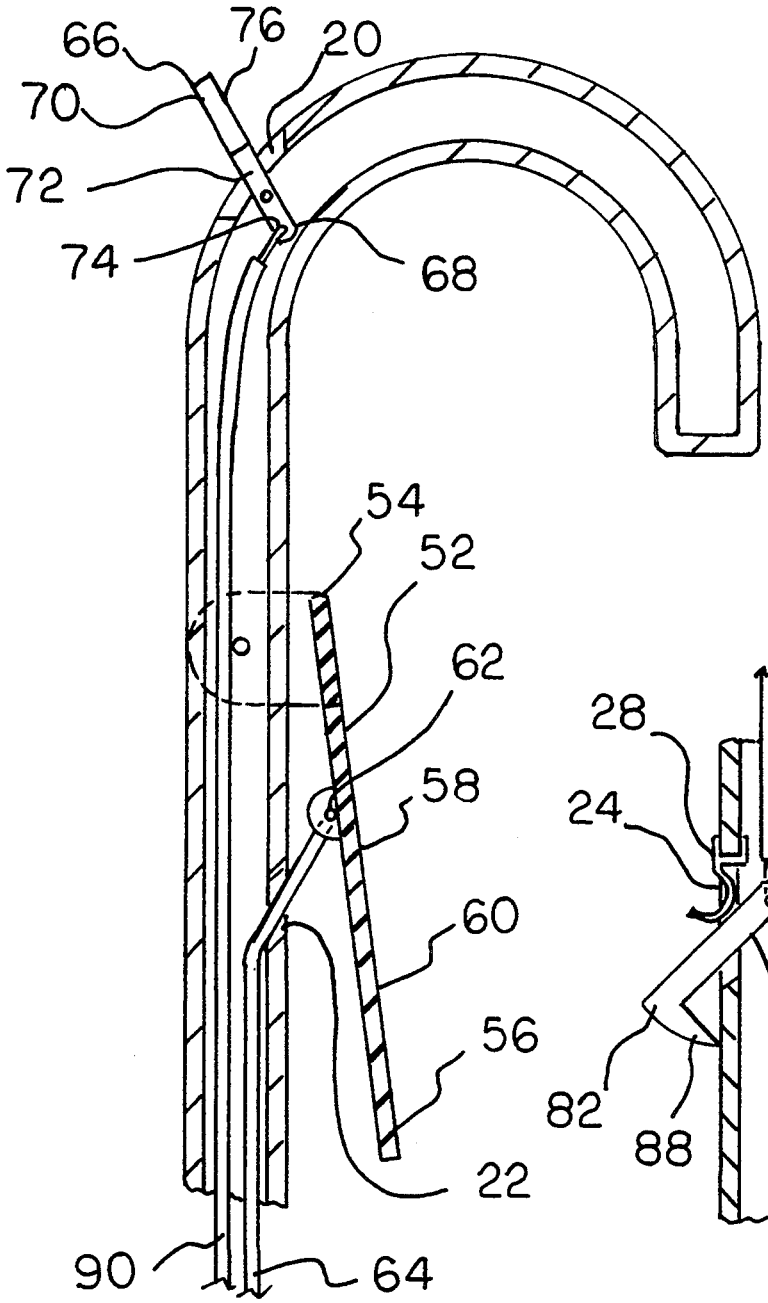
FIG. 5 is a enlarged view of the lift lever, release lever, and associated cables of the present invention taken along the line 5—5 of FIG. 2.
Figure 6:
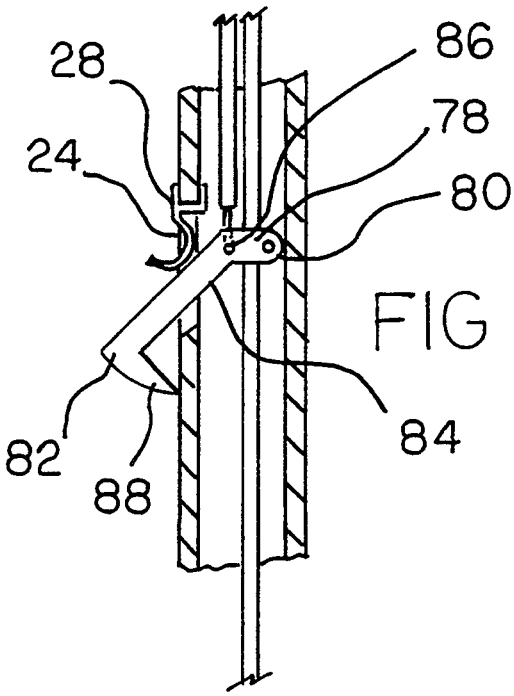
FIG. 6 is an enlarged view of the release detent taken along the line 6—6 of FIG. 2.

With reference now to the drawings, and in particular, to FIG. 1 thereof, the preferred embodiment of the new and improved step cane embodying the principles and concepts of the present invention and generally designated by the reference number 10 will be described.

More specifically, it will be noted in the various Figures that the step cane 10 comprises a rigid and hollow cane 12 for supporting the attitude of a user. The cane has a tip end 14, a handle end 16, and an downwardly extending intermediate portion 18 therebetween. The tip end is adapted to contact a walking surface. The tip end can be fashioned such that optimum contact with the walking surface is maintained. The handle end is adapted to provide a user a firm grip and can have many different shapes for providing sturdy support and balance. The intermediate portion has a releasing aperture 20, a lifting aperture 22, a coupling aperture 24, and an extending aperture 26 disposed thereon. The releasing aperture is disposed near the handle end. The lifting aperture is disposed below the releasing aperture. The coupling aperture is disposed below the lifting aperture. The coupling aperture further includes a clip spring 28 coupled thereto. The extending aperture is disposed below the coupling aperture. The cane can be fashioned such that its height is adjustable.

A platform 30 is rotatably coupled to the cane 12 between the tip end 14 and the extending aperture 26. The platform is operable in an extended position to allow a user to walk up and down stairs and in a retracted position to allow a user to walk on a generally level surface. In the preferred embodiment, the platform is raised about 3 inches from the walking surface, whereby reducing the height of a conventional stair step by half when placed thereon. The platform is large enough to support one foot and a weight of about 300 pounds. The platform can be lightly colored or have fluorescent markings disposed thereon so it be clearly seen in the dark.

The platform further comprises a rigid and essentially rectangular plate 32 having an upper surface 34 and a lower surface 36. The plate is oriented horizontally when in the extended position and oriented vertically when in the retracted position. A first support leg 38 and a second support leg 40 is attached to the lower surface 36 of the plate. The legs extend downward to contact the walking surface when the plate is in the extended position. The tip end 14 of the cane and the two support legs define a tripod for supporting the plate in the preferred embodiment. Other embodiments may include several more legs for supporting the plate. The device includes a first hinge 42 and a second hinge 44. The first hinge is connected between the first support leg 38 and tip end 14 of the cane. The second hinge is connected between the second support leg 40 and tip end 14 of the cane. The hinges are operable in unison to position the plate in either the extended or retracted position. The plate includes a mounting bracket 46 coupled to the upper surface 34. The mounting bracket has a hole 48 disposed thereon adapted to receive a cable.

Coupled between the cane 12 and the platform 30 is a control mechanism 50 to place the platform in either the extended or retracted position. The control mechanism includes an elongated lift lever 52 having a first end 54, second end 56, and intermediate portion 58 therebetween. The first end is rotatably coupled to the cane above the lifting aperture 22. The second end has a handle 60 formed thereon for a user to grip. The intermediate portion has a hole 62 disposed thereon adapted to receive a cable.

The control mechanism includes lifting cable 14. The lifting cable is placed within the intermediate portion 18 of the cane. The lifting cable has one end disposed through the extending aperture 26 and coupled to the hole 48 of the mounting bracket 46. The other end of the lifting cable is disposed through the lifting aperture 22 and coupled to the hole 62 of the lift lever 52. Rotating the handle 60 of the lift lever 52 upwards moves the platform to the retracted position. Rotating the handle 60 downwards moves the platform to the extended position.

The control mechanism includes an elongated release lever 66. The release lever has a first end 68, a second end 70, and intermediate portion 72 therebetween. The first end is disposed within the intermediate portion 18 of the cane. The first end has a hole 74 formed thereon adapted to receive a cable. The intermediate portion 72 of the lift lever extends from the first end 68 through the releasing aperture 20 to the second end 70. The second end has a handle 76 formed thereon for a user to grip.

The control mechanism includes a release detent 78 having a first end 80, a second end 82, and an intermediate portion 84 therebetween. The first end is disposed within the intermediate portion 18 of the cane and has a hole 86 formed thereon adapted to receive a cable. The intermediate portion is coupled to the lifting cable 64 and extends from the first end 80 through the coupling aperture 24 to the second end 82. The second end has a hook 88 formed thereon that is adapted for use as a latch.

The control mechanism includes a releasing cable 90. The releasing cable is placed within the intermediate portion 18 of the cane. The releasing cable has one end coupled to the hole 86 of the release detent 78. The other end of the releasing cable is coupled to the hole 74 of the release lever 66. When the platform 30 is in the extended position, rotating the handle 76 of the release lever 66 downward engages the hook 88 with the clip spring 28 to lock platform in place. Rotating the handle 76 downwards disengages the hook with the clip spring to unlock the platform, thus enabling the platform to be placed in the retracted position with the lift lever 52.

Figure 7:
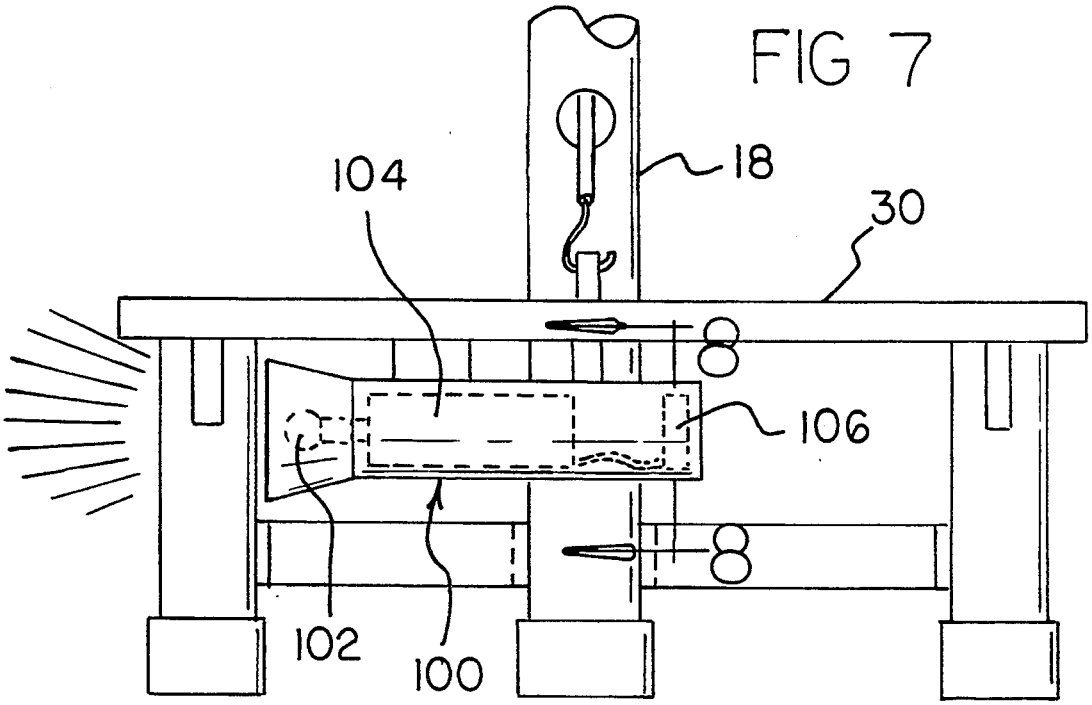
FIG. 7 is a view of another embodiment of the present invention having a light source coupled to the platform.
Figure 8:
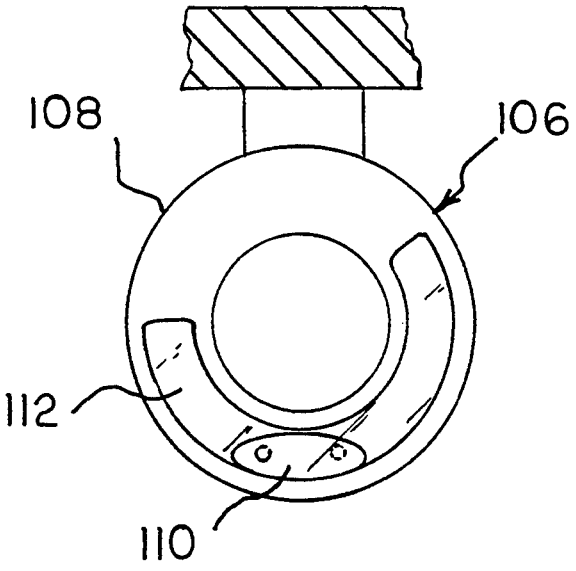
FIG. 8 is a plan view of the mercury switch of the light source taken along the line 8—8 of FIG. 7.

A second embodiment of the device is shown in FIGS. 7 and 8 and includes substantially all of the features of the first embodiment further including a light source 100 coupled to the platform for illuminating stairs when the platform is placed in the extended position. The light source further includes a lamp 102, a power source 104, and a mercury switch 106 electrically connected in series. The mercury switch further includes a container 108, a terminal 110 coupled to the container, and liquid mercury 112 placed in the container. The mercury is adapted to be positioned in one location within the container to electrically couple the terminal with the lamp and power source, whereby energizing the light source, and another location to electrically decouple the terminal from the lamp and power source, whereby de-energizing the light source.

Figure 9:
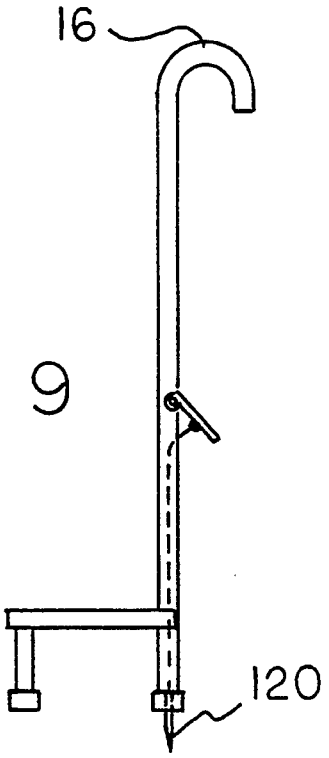
FIG. 9 is a view of yet another embodiment of the present invention having a retractable spike coupled to the cane.

A third embodiment of the present invention is shown in FIG. 9 and includes substantially all of the features of the first embodiment further including a retractable metal spike 120 to the coupled to the control mechanism and the cane near the tip end. The spike can be positioned in a retracted or an extended position. The spike is operated by the controller mechanism to pierce a walking surface when placed in an extended position, whereby allowing the step cane to be used on surfaces where traction is minimal, such as stairs covered with snow or ice.

The present invention is an ingenious device that will be of great assistance to people who are incapacitated to some degree, especially in the lower limbs, either temporarily, or permanently. It can be helpful in many ways, but it is specifically directed at helping those who are having difficulty in raising a leg high enough to reach a stair tread. Even with the support of a cane, some people find it extremely difficult to raise their leg high enough so it can be placed on the step. On stairs which have high risers, the chore is almost impossible for them. This invention helps them to negotiate such obstacles without assistance from anyone. By doing so, it permits them to remain self-sufficient, therefore it is of inestimable value to them psychologically.

The present invention is similar to other sturdy canes, with a choice of handles for sturdy support and balance. It has a platform on the bottom which becomes an intermediate step when a button below the handle is pressed. Two legs drop down to raise the platform about 3 inches above the floor so the step up height is reduced about halfway. The platform is large enough to support one foot and will support up to about 300 pounds in weight safely. When the button is pressed again, the feet retract, allowing the cane to be used in the conventional manner.

There is a distinct need for an aid such as is embodied in this invention. Many thousands of people face this type of problem every day, and for some, the need will persist for the remainder of their lives.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A new and improved step cane for assisting a person in walking up and down stairs comprising, in combination:

a rigid and hollow cane for supporting the attitude of a user, the cane having a tip end, a handle end, and a downwardly extending intermediate portion therebetween, the tip end to contact a walking surface, the handle end to provide a user a firm grip, and the intermediate portion having a releasing aperture, a lifting aperture, a coupling aperture, and an extending aperture disposed thereon, the releasing aperture disposed near the handle end, the lifting aperture disposed below the releasing aperture, the coupling aperture disposed below the lifting aperture and further including a clip spring coupled thereto, and the extending aperture disposed below the coupling aperture;

a platform rotatably coupled to the cane between the tip end and the extending aperture, the platform operable in an extended position to allow a user to walk up and down stairs and in a retracted position to allow a user to walk on a generally level surface, the platform further comprising:

a rigid and essentially rectangular plate having an upper surface and a lower surface, the plate oriented horizontally when in the extended position and oriented vertically when in the retracted position;

a first support leg and a second support leg attached to the lower surface of the plate and extending downward to contact the walking surface when the plate is in the extended position, with the tip end of the cane and the two support legs defining a tripod for supporting the plate;

a first hinge and a second hinge, the first hinge connected between the first support leg and tip end of the cane, the second hinge connected between the second support leg and tip end of the cane, the hinges operable in unison to position the plate in either the extended or retracted position; and a mounting bracket coupled to the plate, the bracket having a hole disposed thereon to receive a cable;

a control mechanism coupled between the cane and platform to place the platform in either the extended or retracted position, the control mechanism further comprising:

an elongated lift lever having a first end, second end, and intermediate portion therebetween, the first end rotatably coupled to the cane above the lifting aperture, the second end having a handle formed thereon, and the intermediate portion having a hole disposed thereon adapted to receive a cable;

a lifting cable placed within the intermediate portion of the cane and having one end disposed through the extending aperture and coupled to the hole of the mounting bracket and the other end disposed through the lifting aperture and coupled to the hole of the lift lever, whereby rotating the handle of the lift lever upwards moves the platform to the retracted position and rotating the handle downwards moves the platform to the extended position;

an elongated release lever having a first end, a second end, and intermediate portion therebetween, the first end having a hole formed thereon and disposed within the cane, the intermediate portion extending from the first end through the releasing aperture to the second end, the second end having a handle formed thereon;

a release detent having a first end, a second end, and an intermediate portion therebetween, the first end having a hole formed thereon and disposed within the cane, the intermediate portion coupled to the lifting cable and extending from the first end through the coupling aperture to the second end, the second end having a hook formed thereon; and a releasing cable placed within the intermediate portion of the cane and having one end coupled to the hole of the release detent and the other end coupled to the hole of the release lever, whereby when the platform is in the extended position, rotating the handle of the release lever downward engages the hook with the clip spring to lock platform in place, and rotating the handle downwards disengages the hook with the clip spring to unlock the platform, thus enabling the platform to be placed in the retracted position with the lift lever.

2. A new and improved step cane for assisting a person in walking up and down stairs comprising:

an elongated and rigid cane for supporting the attitude of a user, the cane having a tip end to contact a walking surface, a handle end to provide a user a firm grip, and a downwardly extending intermediate portion therebetween;

a platform rotatably coupled to the intermediate portion of the cane, the platform operable in an extended position to allow a user to walk up and down stairs and in a retracted position to allow a user to walk on a generally level surface; and controller means positioned on the handle end adjacent to the handle and coupled between the cane and platform to place the platform in either the extended or retracted position.

3. The device as set forth in claim 2 and further comprising:

a light source coupled to the platform for illuminating stairs when the platform is placed in the extended position, the light source further comprising a lamp, a power source, and a mercury switch electrically connected in series, the mercury switch further comprising a container; a terminal coupled to the container; and liquid mercury placed in the container and to be positioned in one location therein to electrically couple the terminal with the lamp and power source whereby energizing the light source, and another location to electrically decouple the terminal from the lamp and power source whereby de-energizing the light source.

4. The device as set forth in claim 2 and further including a retractable spike coupled near the tip of the cane having a retracted and extended position, the spike placed in the extended position by the controller means to piece the walking surface, whereby allowing the step can to be used on surfaces where traction is minimal.

* * * * *